US012612916B2

(12) United States Patent
Avila et al.

(10) Patent No.: US 12,612,916 B2
(45) Date of Patent: Apr. 28, 2026

(54) PORTABLE PUMP WITH TELESCOPIC TUBES

(71) Applicant: TECHTRONIC CORDLESS GP, Anderson, SC (US)

(72) Inventors: Gerardo Quintanilla Avila, Dongguan (CN); Sven Eschrich, Dongguan (CN); Jia Wei Xie, Dongguan (CN)

(73) Assignee: TECHTRONIC CORDLESS GP, Anderson, SC (US)

( * ) Notice: Subject to any disclaimer, the term of this patent is extended or adjusted under 35 U.S.C. 154(b) by 103 days.

(21) Appl. No.: 18/571,128

(22) PCT Filed: Jun. 16, 2021

(86) PCT No.: PCT/CN2021/100225
§ 371 (c)(1),
(2) Date: Dec. 15, 2023

(87) PCT Pub. No.: WO2022/261844
PCT Pub. Date: Dec. 22, 2022

(65) Prior Publication Data

US 2024/0309884 A1 Sep. 19, 2024

(51) Int. Cl.
*F04D 13/06* (2006.01)
*F04D 13/08* (2006.01)
(Continued)

(52) U.S. Cl.
CPC ..... *F04D 13/068* (2013.01); *F04D 13/0693* (2013.01); *F04D 13/08* (2013.01);
(Continued)

(58) Field of Classification Search
CPC ..... F04D 13/08; F04D 29/605; F04D 13/086; F04D 29/607; F04D 29/708;
(Continued)

(56) References Cited

U.S. PATENT DOCUMENTS 3,369,715 A * 2/1968 Carter ..... F04D 29/608 415/199.2
4,021,700 A 5/1977 Ellis-Dear
(Continued)

FOREIGN PATENT DOCUMENTS

AT 522267 A1 9/2020
AU 4557385 A 2/1986
(Continued)

OTHER PUBLICATIONS

International Patent Application No. PCT/CN2021/100225; International Search Report; Nov. 2, 2021; (2 pages).

*Primary Examiner* — Peter J Bertheaud
(74) *Attorney, Agent, or Firm* — Dority & Manning, P.A.

(57) ABSTRACT

A portable pump comprises a pump assembly including a motor, a handle assembly including a power source mounting interface configured to attach to a power source, a pole assembly extending in a longitudinal axis and connecting the pump assembly with the handle assembly, and a cable assembly connecting the motor to transfer power from the power source to the motor. The length of the pole assembly is adjustable by user. The cable assembly at least partially extends in the pole assembly and deforms in the direction of the longitudinal axis to adapt to the adjusted length of the pole assembly.

20 Claims, 15 Drawing Sheets

(51) Int. Cl.

| | |
|---|---|
| ***F04D 13/10*** | (2006.01) |
| ***F04D 15/00*** | (2006.01) |
| ***F04D 29/40*** | (2006.01) |
| ***F04D 29/42*** | (2006.01) |
| ***F04D 29/60*** | (2006.01) |
| ***F04D 29/70*** | (2006.01) |

(52) U.S. Cl.
CPC ..... *F04D 13/086* (2013.01); *F04D 13/10* (2013.01); *F04D 29/406* (2013.01); *F04D 29/426* (2013.01); *F04D 29/4293* (2013.01); *F04D 29/605* (2013.01); *F04D 29/607* (2013.01); *F04D 29/708* (2013.01); *F04D 15/00* (2013.01)

(58) Field of Classification Search
CPC ..... F04D 13/068; F04D 13/10; F04D 29/426; F04D 29/4293; F04D 29/406; F04D 13/0693
See application file for complete search history.

(56) References Cited

U.S. PATENT DOCUMENTS

| | | | |
|---|---|---|---|
| 4,475,872 | A | 10/1984 | Foughty |
| 5,325,885 | A | 7/1994 | Ivan et al. |
| 5,388,966 | A | 2/1995 | Bley |
| 5,664,939 | A | 9/1997 | Giordani et al. |
| 5,799,834 | A | 9/1998 | Small et al. |
| 5,823,578 | A | 10/1998 | Chiou |
| 6,179,558 | B1 | 1/2001 | Eastman, III et al. |
| 6,447,261 | B1 | 9/2002 | McCook |
| 6,547,529 | B2 | 4/2003 | Gross |
| 6,625,519 | B2 | 9/2003 | Goodwin et al. |
| 6,681,801 | B2 | 1/2004 | Hoehn et al. |
| 6,922,348 | B2 | 7/2005 | Nakajima et al. |
| 7,121,433 | B2 | 10/2006 | Nelson et al. |
| 7,284,540 | B2 | 10/2007 | Attwood et al. |
| 7,357,341 | B2 | 4/2008 | Gutwein et al. |
| 7,407,371 | B2 | 8/2008 | Leone et al. |
| 7,442,014 | B1 | 10/2008 | Mellinger et al. |
| 7,810,362 | B2 | 10/2010 | Harwood et al. |
| 7,841,286 | B1 | 11/2010 | Bochenski |
| 8,205,640 | B2 | 6/2012 | Kawamura et al. |
| 8,371,821 | B1 | 2/2013 | More |
| 8,436,559 | B2 | 5/2013 | Kidd et al. |
| 8,564,233 | B2 | 10/2013 | Kidd et al. |
| 8,784,077 | B1 | 7/2014 | Ray |
| 9,660,497 | B2 | 5/2017 | Ladd |
| 10,024,325 | B2 | 7/2018 | Phillips et al. |
| 10,221,853 | B2 | 3/2019 | Nix |
| 10,241,524 | B2 | 3/2019 | Koehl |
| 10,323,647 | B2 | 6/2019 | Grzeika |
| 10,378,544 | B2 | 8/2019 | Rejniak et al. |
| 10,569,311 | B2 | 2/2020 | Oberto et al. |
| 10,590,926 | B2 | 3/2020 | Kidd et al. |
| 10,619,640 | B2 | 4/2020 | Madsen |
| 10,711,474 | B1 | 7/2020 | Rickerson |
| D898,773 | S | 10/2020 | Arkwright et al. |
| 2003/0101523 | A1 | 6/2003 | Lepley |
| 2005/0244287 | A1 | 11/2005 | Dobrynski |
| 2006/0039800 | A1 | 2/2006 | Saunders |
| 2006/0055356 | A1 | 3/2006 | McNulty et al. |
| 2008/0044295 | A1 | 2/2008 | Goliat |
| 2008/0257908 | A1* | 10/2008 | Reelick ..... B05B 9/007 222/63 |
| 2010/0098555 | A1 | 4/2010 | He |
| 2013/0014836 | A1 | 1/2013 | Cain et al. |
| 2013/0309099 | A1 | 11/2013 | Irving et al. |
| 2015/0152860 | A1 | 6/2015 | Treek et al. |
| 2015/0217320 | A1 | 8/2015 | Bonzer |
| 2015/0344286 | A1 | 12/2015 | Taylor |
| 2016/0091130 | A1 | 3/2016 | Thompson |
| 2019/0203724 | A1 | 7/2019 | Kuronuma et al. |
| 2020/0187633 | A1 | 6/2020 | Paratore |
| 2021/0156389 | A1 | 5/2021 | Park |

FOREIGN PATENT DOCUMENTS

| | | | |
|---|---|---|---|
| AU | 2005100918 | A4 | 12/2005 |
| CA | 1241252 | A | 8/1988 |
| CA | 2778149 | A | 1/2013 |
| CN | 201650777 | U | 11/2010 |
| CN | 102077461 | A | 5/2011 |
| CN | 204386901 | U | 6/2015 |
| CN | 205047449 | U | 2/2016 |
| CN | 107420292 | A | 12/2017 |
| CN | 207246495 | U | 4/2018 |
| CN | 105952653 | A | 5/2019 |
| CN | 110541400 | A | 12/2019 |
| CN | 111503013 | A | 8/2020 |
| CN | 111699052 | A | 9/2020 |
| CN | 111734644 | A | 10/2020 |
| CN | 111779683 | A | 10/2020 |
| CN | 212360209 | U | 1/2021 |
| CN | 112879263 | A | 6/2021 |
| DE | 1750399 | A1 | 4/1971 |
| DE | 7423944 | U | 10/1975 |
| DE | 2433802 | A1 | 1/1976 |
| DE | 9405165 | U1 | 6/1994 |
| DE | 19534464 | C1 | 12/1996 |
| DE | 19737670 | A1 | 3/1999 |
| DE | 10142684 | C1 | 11/2002 |
| DE | 20313289 | U1 | 11/2003 |
| DE | 202004008849 | U1 | 12/2004 |
| DE | 202011051043 | U1 | 12/2011 |
| DE | 202013004772 | U1 | 6/2013 |
| DE | 202013001890 | U1 | 2/2014 |
| DE | 202018104627 | U1 | 11/2018 |
| DE | 202020105808 | U1 | 11/2020 |
| DE | 102019218525 | A1 | 6/2021 |
| EP | 0920591 | B1 | 6/2003 |
| EP | 0899461 | B2 | 8/2006 |
| EP | 2439413 | A2 | 4/2012 |
| EP | 2006546 | B1 | 8/2019 |
| FR | 2703409 | A1 | 10/1994 |
| FR | 2979137 | A1 | 2/2013 |
| GB | 844666 | A | 8/1960 |
| GB | 2409009 | A | 6/2005 |
| GB | 2450700 | B | 12/2009 |
| GB | 2518214 | A | 3/2015 |
| GB | 2481424 | B | 9/2015 |
| WO | WO2009006927 | A1 | 1/2009 |
| WO | WO2011035821 | A1 | 3/2011 |

* cited by examiner

PORTABLE PUMP WITH TELESCOPIC TUBES

This application is a National Stage Patent Application of PCT/CN2021/100225, filed on Jun. 16, 2021, the disclosure of which is incorporated by reference herein in its entirety.

TECHNICAL FIELD

The present invention relates generally to pumps, more particularly, to portable pumps having a telescopic pole assembly.

BACKGROUND OF THE INVENTION

Pumps are useful in various tasks including garden irrigation, rainwater collection, and pond draining. Submersible pumps with a centrifugal impeller are often used in home and garden applications. Typically, submersible pumps have long electrical cables for connecting the pump arrangement to a power source. These cables are often exposed to environment and may be damaged or cause safety issues. While some submersible pumps are provided with a separate control unit which allows a remote control, it is not easy to move the pump during operation. Further, the size of conventional submersible pumps makes it difficult to reach a narrow area.

Accordingly, there is a need for a portable pump with improved handling to adapt to different working environments.

SUMMARY OF THE INVENTION

The present invention is directed to a portable pump comprising a pump assembly, a handle assembly including a power source mounting interface configured to attach to a power source, a pole assembly connecting the pump assembly and the handle assembly, and a cable assembly electrically connecting the motor to transfer power from the power source to the motor. In accordance with embodiments of the invention, the cable assembly at least partially extends in the pole assembly. The length of the pole assembly is adjustable by user. The cable assembly deforms to adapt to the adjusted length of the pole assembly.

In one example, the cable assembly includes at least one spring-shaped section which is extendable or retractable in response to a change of the length of the pole assembly. The cable assembly extends into a motor housing in the pump assembly and a pipe fitting in the handle assembly. A first sealing element is provided between the pipe fitting and the cable assembly. A second sealing element is provided between the motor housing and the cable assembly. The spring-shape section is located between the first sealing element and the second sealing element.

In another example, the power source mounting interface is positioned at the end of the handle assembly opposite to the pole assembly. The power source mounting interface includes a hollow post extending towards a grip portion for receiving a part of the power source. The control unit of the portable pump includes a circuit board that is supported on the hollow post. At least one pump control element is positioned to the rearward of a grip portion of the handle assembly. Optionally, a water-sealed case for accommodating the power source is hinged on a handle housing of the handle assembly.

According to another aspect of the invention, the pole assembly comprises an outer tube, an inner tube slidably disposed in the outer tube, a locking mechanism for releasably locking the position of the inner tube relative to the outer tube, and a slider coupled to an end of the inner tube and defining a limit position of the sliding movement.

In one embodiment, the locking mechanism includes a locking collar secured to the outer tube, and a locking nut rotatable around the inner tube. The locking collar has a first portion secured to the outer tube and a second portion for engaging with the locking nut. A gasket is disposed between the inner tube and the first portion of the locking collar in a radially direction and between the outer tube and the second portion of the locking collar in an axial direction.

In another embodiment, the locking nut has a first portion for engaging with the locking collar and a second portion for locking the position of the inner tube. A compressible element is disposed between the second portion of the locking nut and the inner tube. The second portion of the locking nut has a tapered inner wall and the compressible element has a tapered outer wall. When the locking nut is tightened on the locking collar, the tapered inner wall of the locking nut pushes the tapered outer wall of the compressible element, thereby locking the position of the inner tube relative to the outer tube.

According to a further aspect of the invention, the pump assembly comprises a pump housing, a strainer mounted to the bottom end of the pump housing and defining a pump inlet, an impeller, a motor housing positioned in the pump housing, and a cap member which defines at least a part of a pump chamber in which the impeller is disposed. Liquid drawn from the pump inlet is moved by the impeller to flow radially outward through the pump chamber, upward through an annular region between the pump housing and the motor housing, and to the pole assembly.

In one embodiment, the cap member is mounted to the pump housing and the motor housing. The cap member has a bowl-shaped inner wall which defines a boundary of the pump chamber. At least one first fastener hole is formed on a lug extending from the outer wall of the cap member. The first fastener hole receives a first fastener for mounting the cap member to the pump housing. At least one second fastener hole is formed on a post extending from the inner wall of the cap member. The second fastener hole receives a second fastener for mounting the cap member to the motor housing.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, reference is made to the following descriptions taken in conjunction with the accompanying drawing, in which.

DETAILED DESCRIPTION OF THE INVENTION

Figure 1:
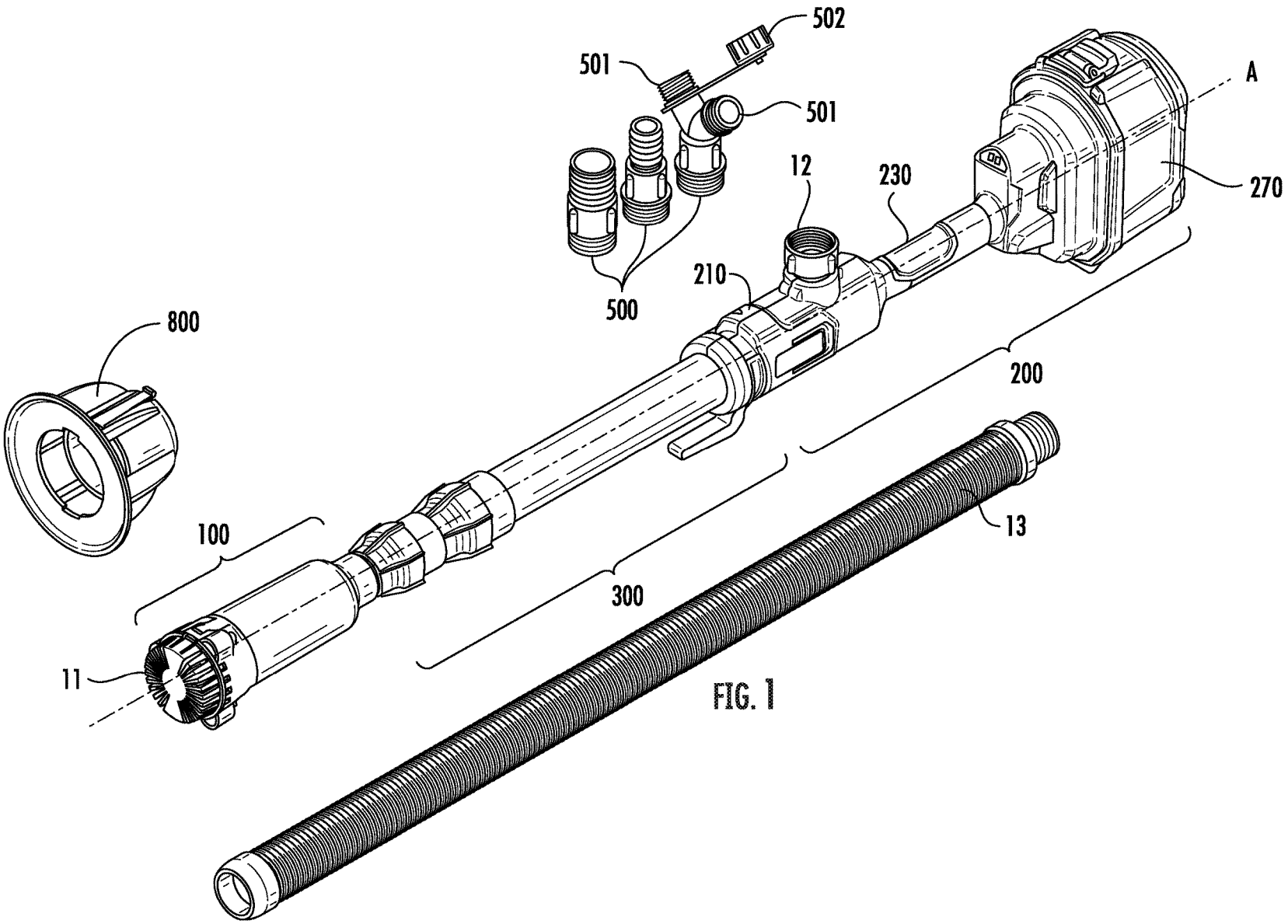
FIG. 1 is a perspective view of a portable pump according to an embodiment of the present invention.

FIG. 1 shows a portable pump according to an embodiment of the present invention. The portable pump generally comprises a pump assembly 100, a handle assembly 200 and a pole assembly 300 connecting the pump assembly 100 with the handle assembly 200. The pump assembly 100 may be a submersible type pump mounted to the lower end of the pole assembly 300. The handle assembly 200 is coupled to the upper end of the pole assembly 300. In the illustrated embodiment, the pump assembly 100, handle assembly 200 and pole assembly 300 extends in a common longitudinal axis A. In other embodiments, the pump assembly 100 and/or the handle assembly 200 can be connected to the pole assembly 300 in a manner that allows a user to change the orientation of the pump assembly 100 and/or the handle assembly 200 according to different applications. For example, the pump assembly 100 can be mounted to the lower end of the pole assembly 300 such that the pump assembly 100 is rotatable around an axis substantially perpendicular to the longitudinal axis A.

The portable pump can be a cordless pump powered by a power source attached to the handle assembly 200. The power source can be a rechargeable battery pack. The handle assembly 200 includes a grip portion 230 located away from the pump assembly 100. In operation, a user can hold the grip portion 230 and move the pump assembly 100 to a desired place.

Figure 2:
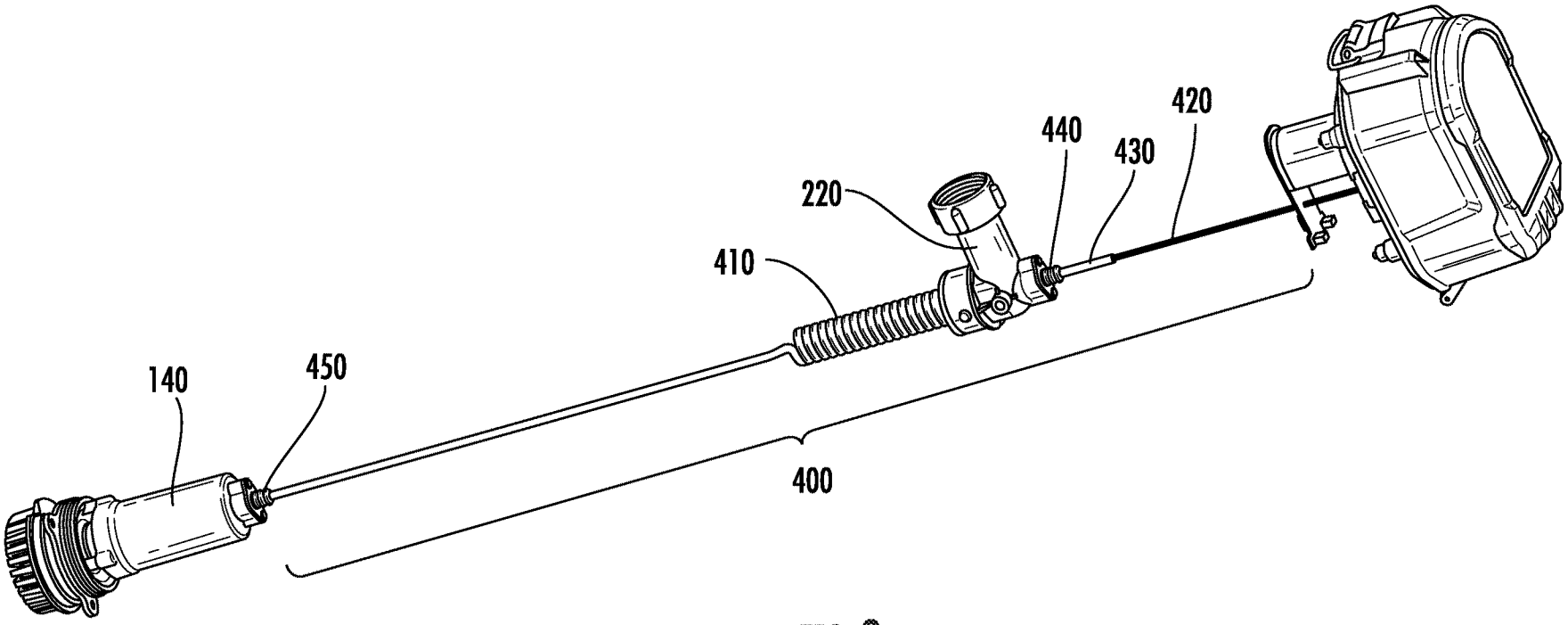
FIG. 2 is a perspective view showing the configuration of a cable assembly in the portable pump.

FIG. 2 shows the configuration of components in the portable pump in FIG. 1. Housings of the pump assembly 100, handle assembly 200 and pole assembly 300 are removed to clearly show the components. The portable pump includes a cable assembly 400 electrically connecting the pump motor in the pump assembly 100. In this embodiment, the cable assembly 400 is accommodated in the pole assembly 300 and may extend into the pump assembly 100 as well as the handle assembly 200. Accordingly, electrical cables of the portable pump are not exposed to environment. The cable assembly 400 may transport power from a battery pack to the motor and also transfer control signals between the motor and a control unit of the pump.

The pole assembly 300 of the illustrated embodiment is designed as a telescope tube assembly. A user is allowed to adjust the length of the pole assembly before moving the pump assembly 100 to a working location. Detailed structure of the pole assembly 300 will be described later.

In order to adapt to the adjusted length of the pole assembly 300, the cable assembly 400 is designed to be deformable in the direction of the longitudinal axis A. In one embodiment, the cable assembly 400 may have a resilient portion which is extendable or retractable in response to a change of the length of the pole assembly 300. Referring to FIG. 2, the cable assembly 400 includes one or more electrical wires 420 and a sleeve or jacket 430 for protecting the electrical wires 420. The sleeve 430 has a spring-shaped section 410 which is positioned in the pole assembly 300. In other embodiments, the sleeve 430 may include multiple spring-shaped sections along the length of the cable assembly 400. The spring-shaped sleeve 430 automatically extends or retracts without causing damage to the electrical wires 420. Preferably, the sleeve 430 is made of a waterproof material to ensure that liquid flowing through the pole assembly 300 does not contact the conductive part of the electrical wires 420.

Figure 3:
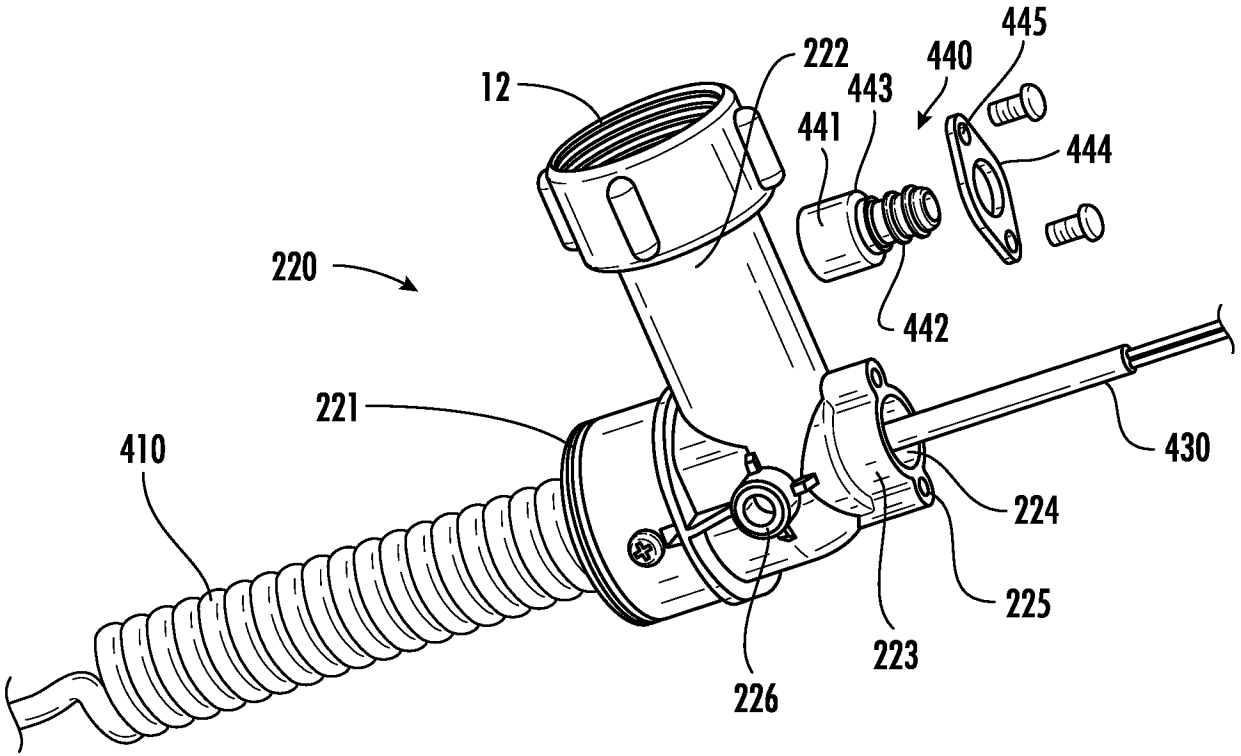
FIG. 3 is a perspective view showing a pipe fitting in a handle assembly and its connection with the cable assembly.

As seen in FIGS. 1 and 2, the upper portion of the cable assembly 400 extends into the handle assembly 200 and passes through a pipe fitting 220. The lower portion of the cable assembly 400 terminates in a motor housing 140 in the pump assembly 100. FIG. 3 depicts an embodiment of the pipe fitting 220 and a portion of the cable assembly 400. The pipe fitting 220 is at least partially disposed in the handle housing 210 shown in FIG. 1. The pipe fitting 220 has an inlet portion 221 connected to the upper end of the pole assembly 300, and an outlet portion 222 forming a pump outlet 12. In this embodiment, the inlet portion 221 extends along the longitudinal axis. Coupling features, such as threads and fastener holes, can be formed on the inlet portion 221. The outlet portion 222 is angled relative to the inlet portion 221. FIG. 3 shows the outlet portion 222 is substantially perpendicular to the inlet portion 221.

To prevent liquid from flowing upward to a chamber inside the handle housing where electronic components are located, the pipe fitting 220 is provided with a sealed portion 223. The sealed portion 223 is aligned with the inlet portion 221 along the longitudinal axis so that the cable assembly 400 can pass through the sealed portion 223 without deflection. A first sealing element 440 is used to seal an opening 224 of the pipe fitting 220. The first sealing element 440 can be a separate element mounted to the sealed portion 223 or an integral part of the sealed portion 223. In the illustrated embodiment, the first sealing element 440 has a first portion 441 at least partially fit in the opening 224. The first portion 441 is positioned between the inner wall of the sealed portion 223 and the cable assembly 400 in the radial direction. The first sealing element 440 may also include a second portion 442 at least partially extending beyond the opening 224. The second portion 442 may be coupled to the grip portion 230 (shown in FIG. 5). A step 443 is formed between the first and second portions 441, 442. A mounting plate 444 may rest on the step 443. Fastener holes 225, 445 are formed on the sealed portion 223 and the mounting plate 444 to receive fasteners for fixing the first sealing element 440 to the sealed portion 223.

In an exemplary configuration, the cable assembly 400 is fixed to the sealed portion 223 of the pipe fitting 220. For example, the sleeve 430 can be fixed to the first sealing element 440 such that the cable assembly 400 is not slidable with respect to the sealed portion 223. As a result, the section of the cable assembly 400 beyond the sealed portion 223 does not experience a deformation when the length of the pole assembly is changed. This ensures the electric wires 420 near the upper end of the cable assembly 400 are not tensioned. Accordingly, it is unnecessary to provide a spring-shaped or spiral-shaped sleeve 430 in this section of the cable assembly 400.

Additionally, the pipe fitting 220 may further include at least one positioning feature 226 formed on its outer surface. As an example, the positioning feature 226 can be a cylindrical projection which engages with a corresponding positioning feature formed on the inner wall of the handle housing 210. The positioning feature 226 may also function as a vibration damping element between the pipe fitting 220 and the handle housing 210.

The outlet portion 222 of the pipe fitting 220 can be coupled to a tube or hose for discharge liquid being pumped. In the illustrate embodiment, the outlet portion 222 includes a threaded inner wall which allows a direct connection with a tube or hose 13 shown in FIG. 1. Additionally or alternatively, an adapter may be attached to the outlet portion 222. FIG. 1 shows three types of adapters 500 having couplers designed for different types of tubes and hoses. In an example, the adapter 500 includes a Y-shaped coupler having two branches 501 with a cover 502.

Figure 4:
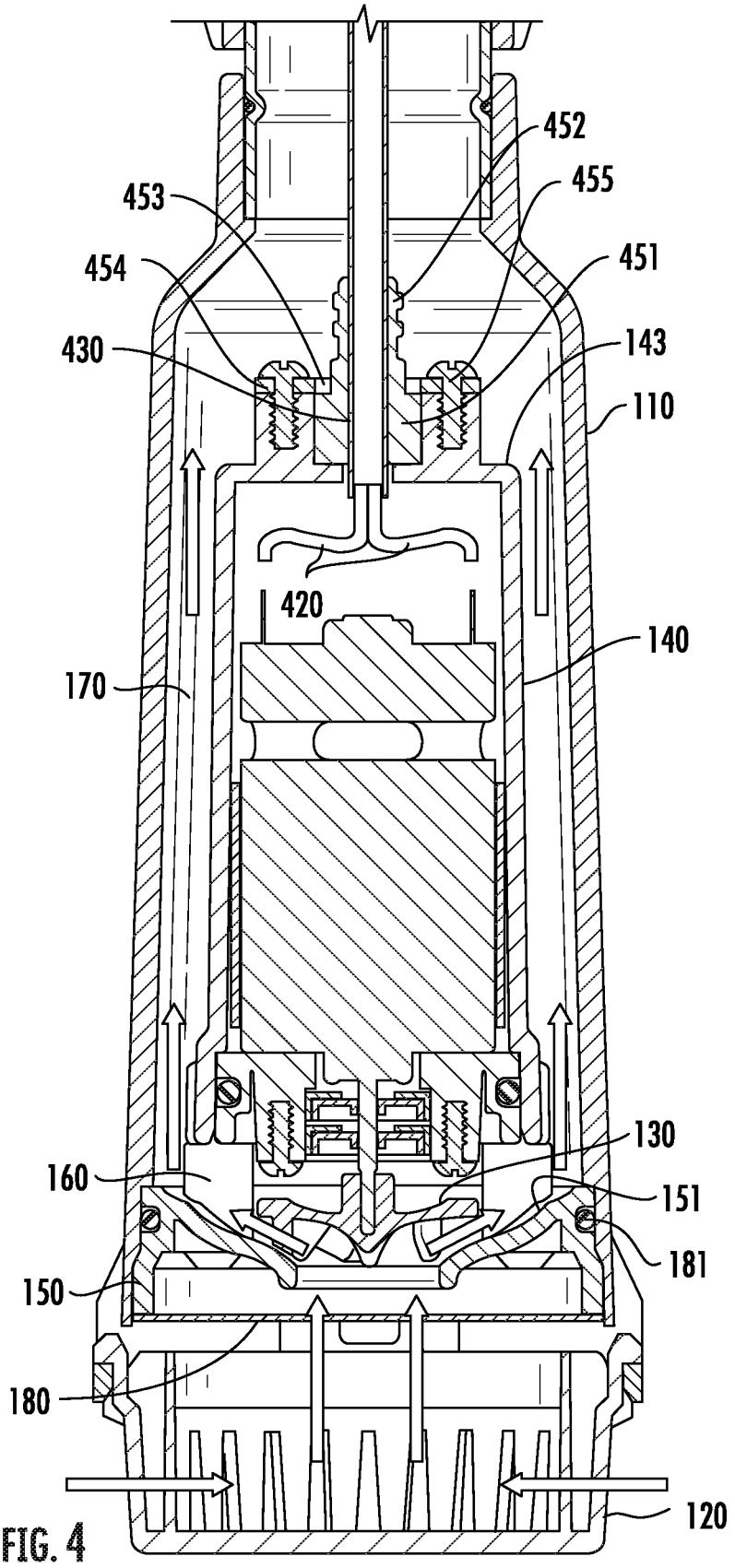
FIG. 4 is a sectional view of a pump assembly.

Back to FIG. 2, the lower portion of the cable assembly 400 extends into the motor housing 140. A second sealing element 450 is used to seal the opening of the motor housing 140. One possible configuration of the lower portion of the cable assembly 400 is shown in FIG. 4. The second sealing element 450 can be a separate element mounted to the top wall or cover 143 of the motor housing 140 or can be integrally formed with the motor housing 140. Similar to the first sealing element 440, the second sealing element 450 may have a first portion 451 at least partially received in the opening and a second portion 452 at least partially extending beyond the opening. A mounting plate 454 may rest on a step 453 between the first and second portions 451, 452. Fastener holes are formed on the top cover 143 as well as the mounting plate 454 to receive fasteners 455 for fixing the second sealing element 450 to the top cover 143.

In some embodiments, the lower portion of the cable assembly 400 can be fixed relative to the motor housing 140. For example, the sleeve 430 is fixed to the second sealing element 440 such that the cable assembly 400 is not slidable with respect to the motor housing 140. As a result, the section of the cable assembly 400 between the top cover 143 and the motor does not experience a deformation when the length of the pole assembly is changed. This ensures the electric wires 420 near the lower end of the cable assembly 400 are not tensioned. Accordingly, as shown in FIG. 2, the spring-shaped section 410 is located between the first sealing element 440 and the second sealing element 450.

Figure 5:
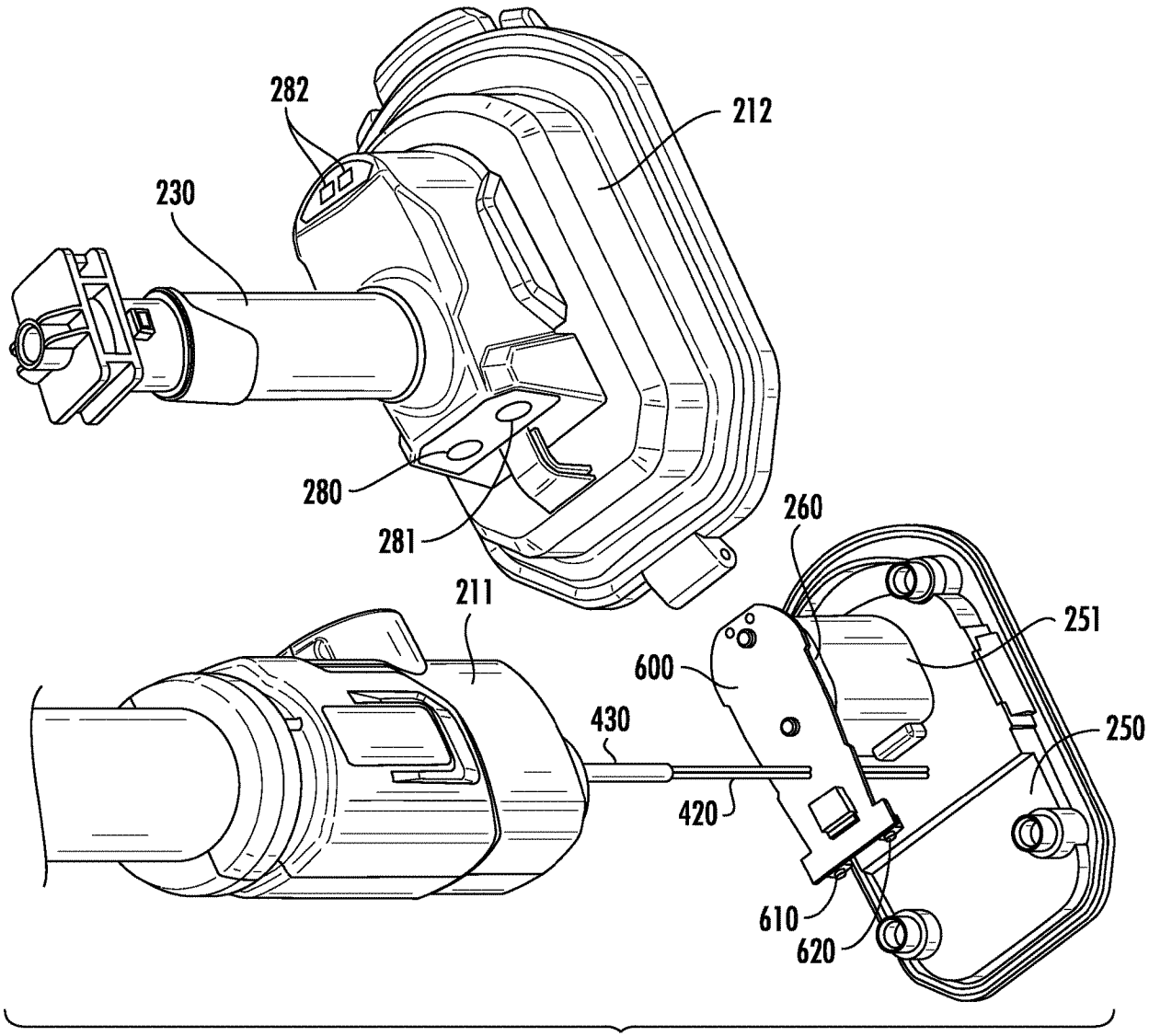
FIG. 5 is an exploded perspective view of the handle assembly.

FIG. 5 shows an embodiment of the handle assembly 200. The handle housing 210 includes a front housing portion 211 which receives a part of the pipe fitting 220 and a rear housing portion 212 which receives a power source mounting interface 250. The grip portion 230 is positioned between the front and rear housing portions 211, 212. In the illustrated embodiment, the grip portion 230 generally extends along the longitudinal axis of the pump. Length of the grip portion 230 is designed to fit a user's hand. Cross sectional area of the grip portion 230 is made smaller than that of the front and rear housing portions 211, 212. In another embodiment, the grip portion 230 together with the rear housing portion 212 may be rotatable with respect to the front housing portion 211.

The power source mounting interface 250 may be positioned at the end of the handle assembly 200 opposite to the pole assembly 300. In an example, the power source mounting interface 250 includes a hollow post 251 extending towards the grip portion 230 for receiving a part of the power source, e.g. a battery pack. It should be appreciated that the power source mounting interface may directly engage with a battery pack or may receive an adaptor to which a battery pack is attachable.

FIG. 5 further shows a control unit 600 of the portable pump. In the illustrated embodiment, the control unit 600 is positioned in the rear housing portion 212 of the handle housing 210 and is close to the power source mounting interface 250. The control unit 600 may include a circuit board that is supported on the hollow post 251 of the power source mounting interface 250. A mounting base 260 can be provided between the hollow post 251 and the circuit board.

The handle assembly 200 may also include one or more control elements for user to operate the pump. For example, control elements 280, 281 are provided on the rear housing portion 212 such that they are reachable by a user's thumb when the user's hand is holding the grip portion 230. The control elements 280, 281 may trigger switches 610, 620 on the control unit 600. Optionally, at least one light emitting element 282 (e.g. LED) can be provided on the handle assembly 200. The light emitting element provides visual indications of operation mode, power level, speed level, warning message, etc.

In one embodiment, the control unit 600 of the pump monitors the motor current level. If the motor current level falls below a threshold, it normally means the pump is running without liquid. To protect the pump from dry running, the control unit will shut off the motor if the motor current level remains below the threshold for a period of time. The threshold may be fixed or adjustable. Additionally or alternatively, a liquid pressure sensor or a liquid level sensor can be used to determine whether the pump is running without liquid.

Referring back to FIG. 1, a water-sealed case 270 is provided for accommodating the power source. In the illustrated embodiment, the water-sealed case 270 is hinged on the rear housing portion 212 of the handle housing 210. The water-sealed case 270 may include one or more sealing elements and/or a locking mechanism to prevent liquid from entering the case and contacting the power source mounting interface 250.

Figures 6A, 6B:
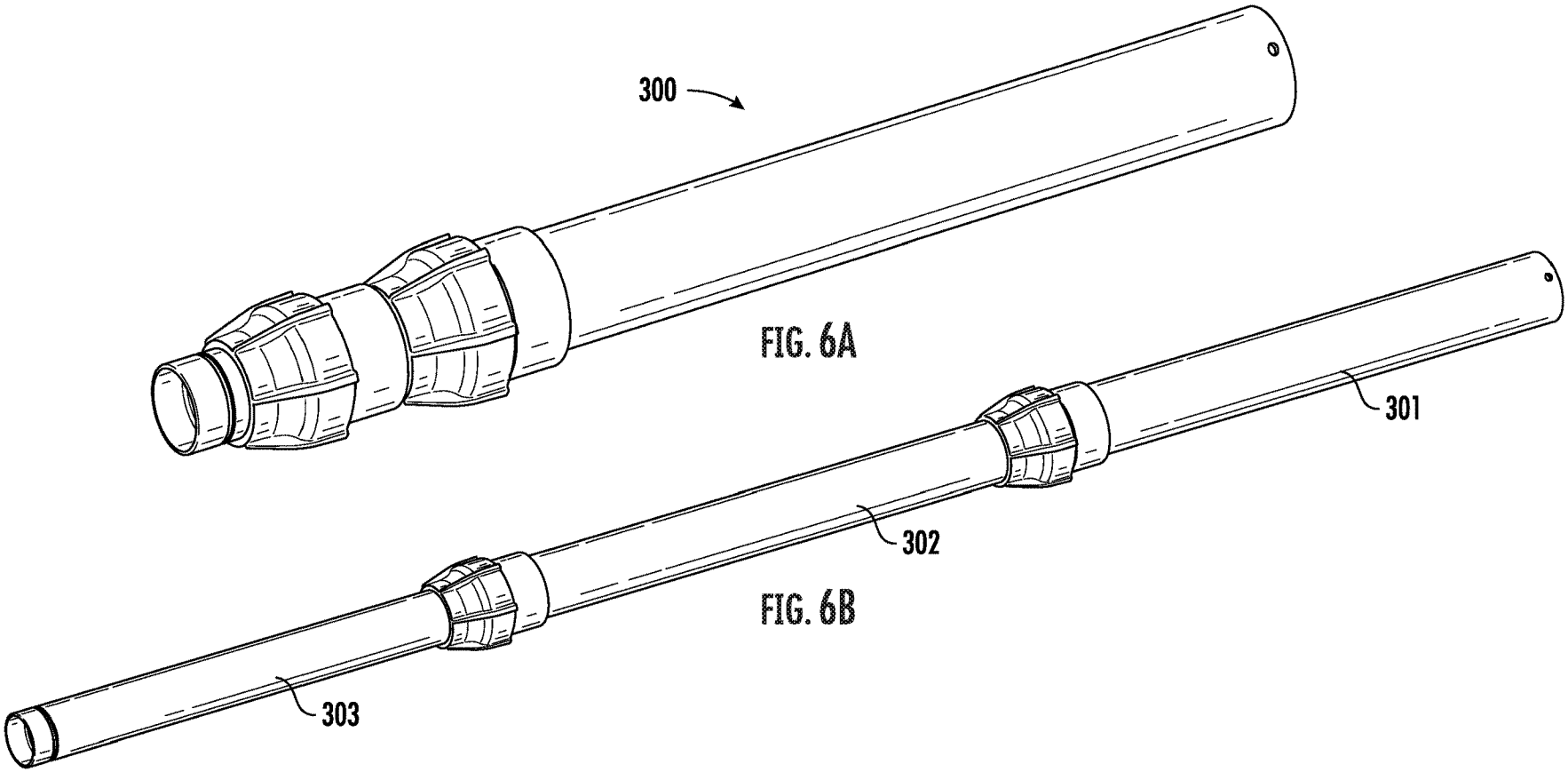
FIG. 6A is a perspective view of a pole assembly in a fully retracted state.
FIG. 6B is a perspective view of the pole assembly in a fully extended state.

FIGS. 6A and 6B show the pole assembly 300 according to one embodiment of the present invention. The pole assembly 300 comprises two or more tubes 301, 302, 303 of different diameters arranged in a telescopic configuration. In an example, the outermost tube 301 having the largest diameter is removably connected to the pipe fitting 220 in the handle assembly 200. The innermost tube 303 having the smallest diameter is removably connected to the pump housing 110 in the pump assembly 100. More than one connection means may be used to ensure a firm connection during operation of the pump. For example, the outermost tube 301 can be connected to the pipe fitting 220 by means of a snap-fit connection, a threaded connection and/or a screw connection. Alternatively, the outermost tube 301 and/or innermost tube 303 may be permanently fixed to the pipe fitting 220 and/or the pump housing 110, for example by means of welding or adhesives. Optionally, length scales are marked on the tubes.

The inner space of pole assembly 300 defines the flow passage. Since a part of the flow passage is occupied by the cable assembly 400, in particular the spring-shaped section 410, the tubes 301, 302, 303 needs to be properly sized to avoid reducing the pumping efficiency. Preferably, a ratio of the maximum outer diameter of the cable assembly 400 (outer diameter of the spring-shaped section 410) to the inner diameter of the innermost tube 303 is in the range of 0.3-0.9, such as in the range of 0.5-0.8. Preferably, a ratio of the maximum outer diameter of the cable assembly 400 to the inner diameter of the outermost tube 301 is in the range of 0.2-0.8, such as in the range of 0.5-0.7.

In one embodiment, when the pole assembly 300 is in the fully retracted or collapsed state as shown in FIG. 6A, a ratio of the length of the pump assembly 100 along the longitudinal axis to the overall length of the portable pump is larger than 0.15, such as in the range of 0.2-0.4. When the pole assembly is in the fully extended state as shown in FIG. 6B, the ratio of the length of the pump assembly 100 along the longitudinal axis to the overall length of the portable pump is smaller than 0.15.

Figure 7:
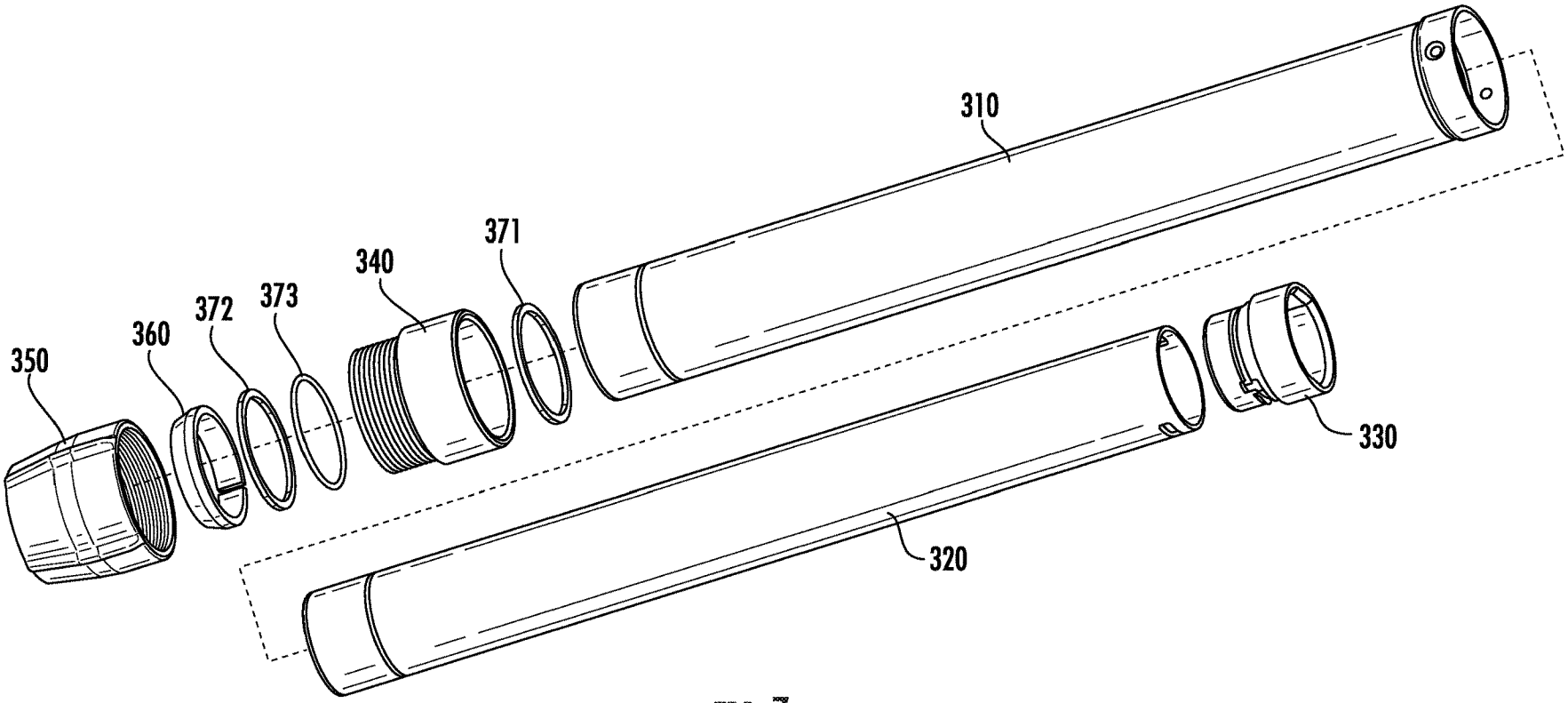
FIG. 7 is an exploded perspective view of a part of the pole assembly.

FIG. 7 shows the components of a part of the pole assembly 300 according to one embodiment. The pole assembly 300 comprises an outer tube 310 having a larger diameter, an inner tube 320 having a smaller diameter, and a locking mechanism for releasably locking the position of the inner tube 320 relative to the outer tube 310. A separate slider 330 is included in the pole assembly 300 to provide a smooth sliding movement of the inner tube 320 in the outer tube 310. The locking mechanism in the illustrated embodiment includes a locking collar 340 secured to the outer tube 310, a locking nut 350 rotatably disposed around the inner tube 320, and a compressible element 360 between locking nut 350 and the inner tube 320.

Figures 8A, 8B, 8C, 8D:
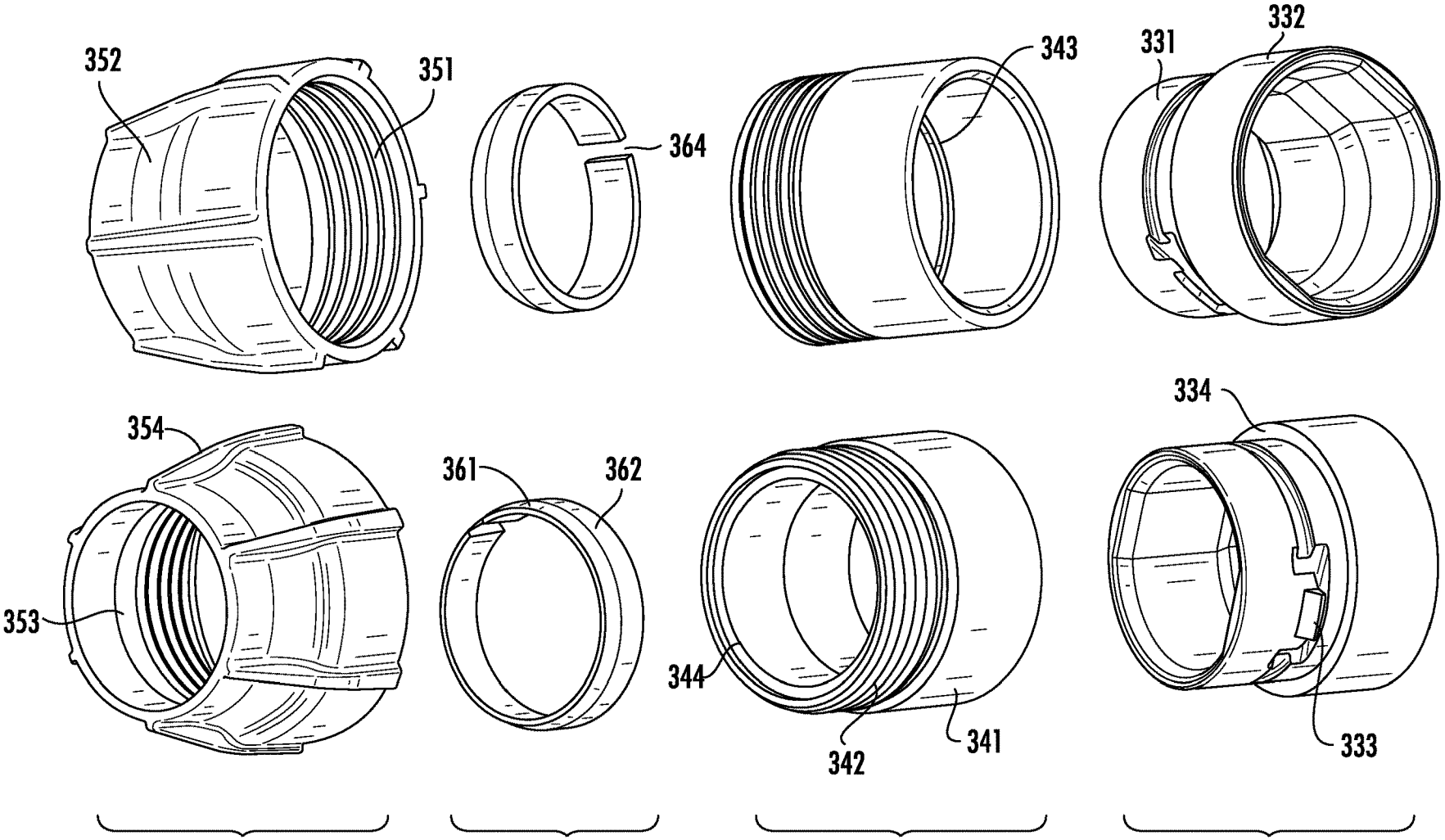
FIG. 8A is a perspective view of a locking nut in a locking mechanism in the pole assembly.
FIG. 8B is a perspective view of a compressible element in the locking mechanism.
FIG. 8C is a perspective view of a locking collar in the locking mechanism.
FIG. 8D is a perspective view of a slider in the pole assembly.
Figure 9:
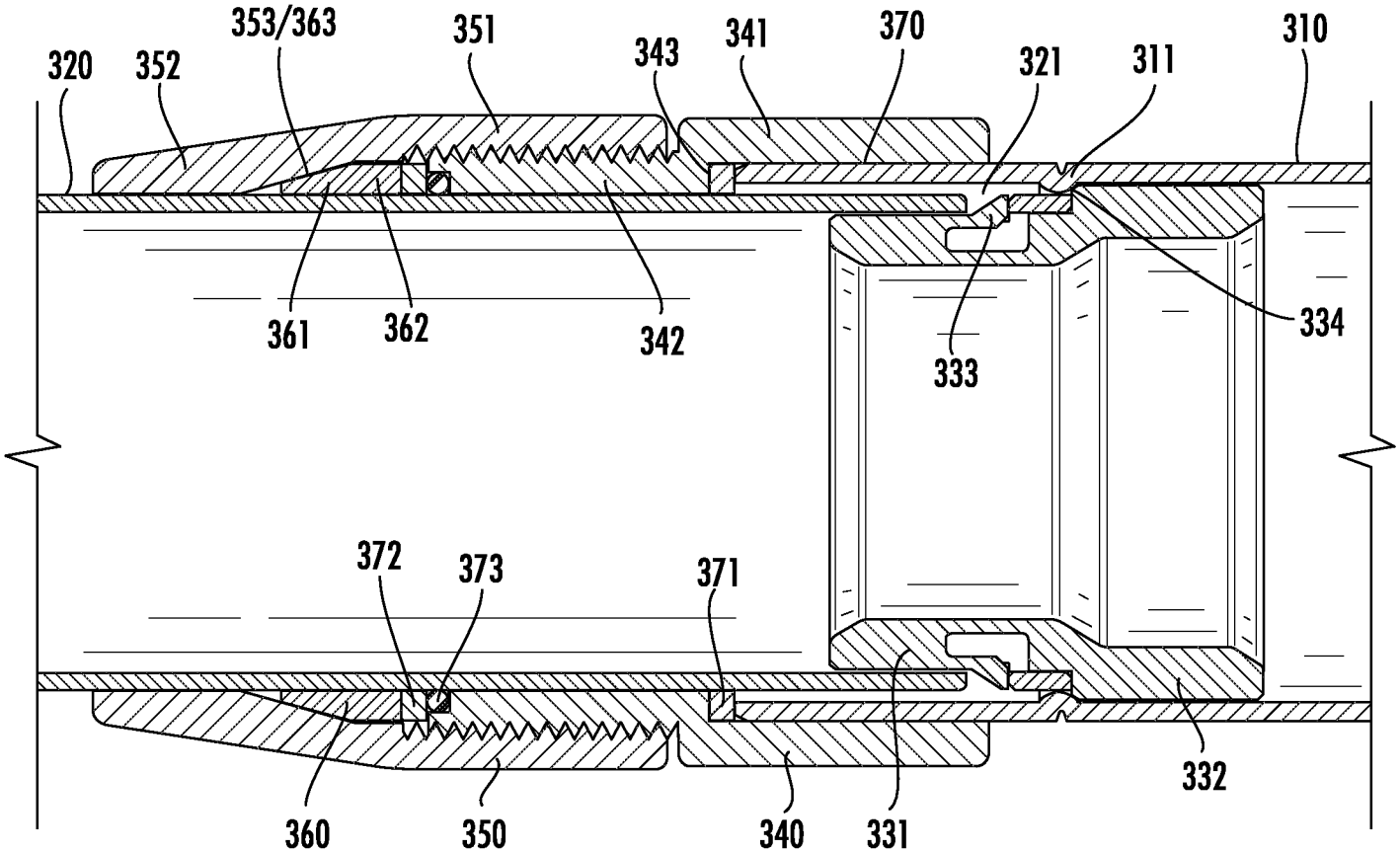
FIG. 9 is a sectional view of a part of the pole assembly.

FIGS. 8A to 8D respectively show the locking nut 350, compressible element 360, locking collar 340 and slider 330. FIG. 9 shows the cross section of a part of the pole assembly 300 in the fully extended state. As seen in FIG. 8D, the slider 330 has a coupling portion 331 configured to be coupled to an end of the inner tube 320 and an enlarged portion 332 whose outer diameter is larger than the outer diameter of the inner tube 320. The slider 300 further includes a mounting feature 333 on the coupling portion 331 and a step 334 formed between the coupling portion 331 and the enlarged portion 332. On the other hand, a mounting opening 321 is formed near the end of the inner tube 320 to receive the mounting feature 333. A snap fit can be achieved between the slider 330 and the inner tube 320. Further, a radially inward projection 311 is formed on the outer tube 310. The radially inward projection 311 functions a stop which defines a limit position. When the step 334 abuts against the radially inward projection 311, the inner tube 320 reaches the limit position. In another embodiment, the slider 330 can be removed to simplify the structure. Instead the enlarged portion 332 and the step 334 are integrally formed with the inner tube 320.

Referring to FIG. 9, the locking collar 340 may be secured to an end of the outer tube 310 via interference fit. Additionally or alternatively, a layer of adhesive 370 may be applied at an interface between the locking collar 340 and the outer tube 310.

FIG. 8C depicts an exemplary embodiment of the locking collar. The locking collar 340 has a first portion 341 secured to the outer tube 310 and a second portion 342 for engaging with the locking nut 350. The inner diameter of the second portion 342 of the locking collar 340 is smaller than the inner diameter of the outer tube 310. A step 343 is formed between the inner wall of the first portion 341 and the second portion 342. The second portion 342 of the locking collar 340 may have a threaded outer wall.

FIG. 8A depicts an exemplary embodiment of the locking nut. The locking nut 350 has a first portion 351 for engaging with the locking collar 340 and a second portion 352 for locking the position of the inner tube 320. The first portion 351 of the locking nut 350 may have a threaded inner wall. The second portion 352 of the locking nut 350 has a tapered inner wall 353. Optionally, one or more ribs 354 are formed on the outer wall of the locking nut 350. The ribs 354 allow user to easily rotate the locking nut 350.

FIG. 8B depicts an exemplary embodiment of the compressible element. The compressible element 360 has a first portion 361 defining a tapered outer wall 363 and a second portion 362 extending from the first portion in the axial direction. The compressible element 360 may be designed as a C-shaped ring having a gap 364 between opposite ends. As shown in FIG. 9, when the locking nut 350 is tightened on the locking collar 340, the tapered inner wall 353 of the locking nut 350 pushes the tapered outer wall 363 of the compressible element 360 against the inner tube 320. The force applied by the compressible element 360 on the inner tube 320 locks the position of the inner tube 320 relative to the outer tube 310.

To prevent leakage, one or more sealing elements are included in the pole assembly 300. For example, in FIG. 9, a first gasket 371 is disposed between the inner tube 320 and the first portion 341 of the locking collar 340 in the radially direction and between the outer tube 310 and the step 343 of the locking collar 340 in the axial direction. A second gasket 372 is positioned between the second portion 362 of the compressible element 360 and the second portion 342 of the locking collar 340 in the axial direction. An O-shaped ring 373 is further positioned between the second gasket 372 and the second portion 342 of the locking collar 340 in the axial direction. Referring to FIG. 8C, an annular groove 344 is formed on the inner wall of the second portion 342 of the locking collar 340 to receive the O-shaped ring 373.

Figure 10:
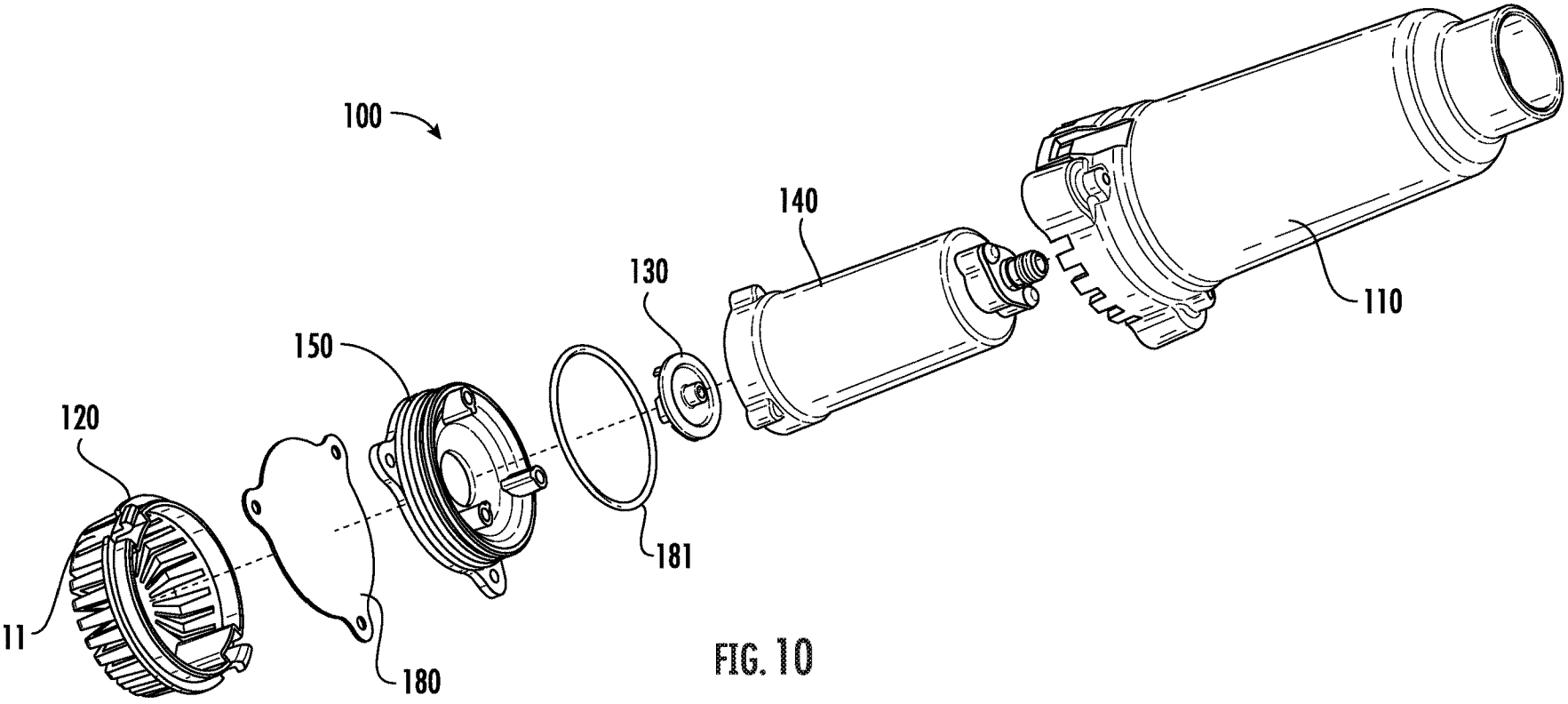
FIG. 10 is an exploded perspective view of the pump assembly.

FIG. 10 shows the components in the pump assembly 100 according to one embodiment. The pump housing 110 of the pump assembly 100 is connected to the lower end of the pole assembly 300. A strainer 120 is mounted to the bottom end of the pump housing 110. The strainer 120 defines a pump inlet 11 through which liquid flows into the pump assembly 100. A motor housing 140 is positioned inside the pump housing 110. An impeller 130 is coupled to the drive shaft of the motor. A cap member 150 is positioned between the strainer 120 and the motor housing 140. The cap member 150 defines a part of a pump chamber 160 in which the impeller 130 is disposed. Referring back to FIG. 4, when the motor drives the impeller 130 to rotate, liquid drawn from the pump inlet 11 is moved by the impeller 130 to flow radially outward through the pump chamber 160, upward through an annular region 170 between the pump housing 110 and the motor housing 140, and to the flow passage in the pole assembly 300. In this embodiment, the motor housing 140 is sealed to prevent liquid from entering the motor housing 140 during operation of the pump.

Figure 11B:
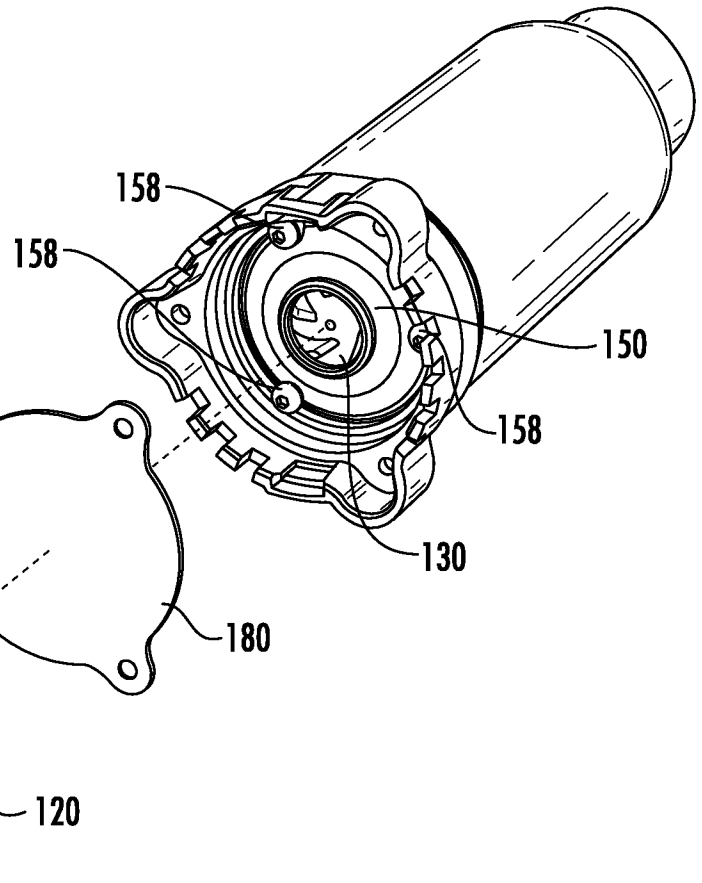
FIG. 11B is a perspective view of the pump assembly with the strainer and filter removed.
Figure 11A:
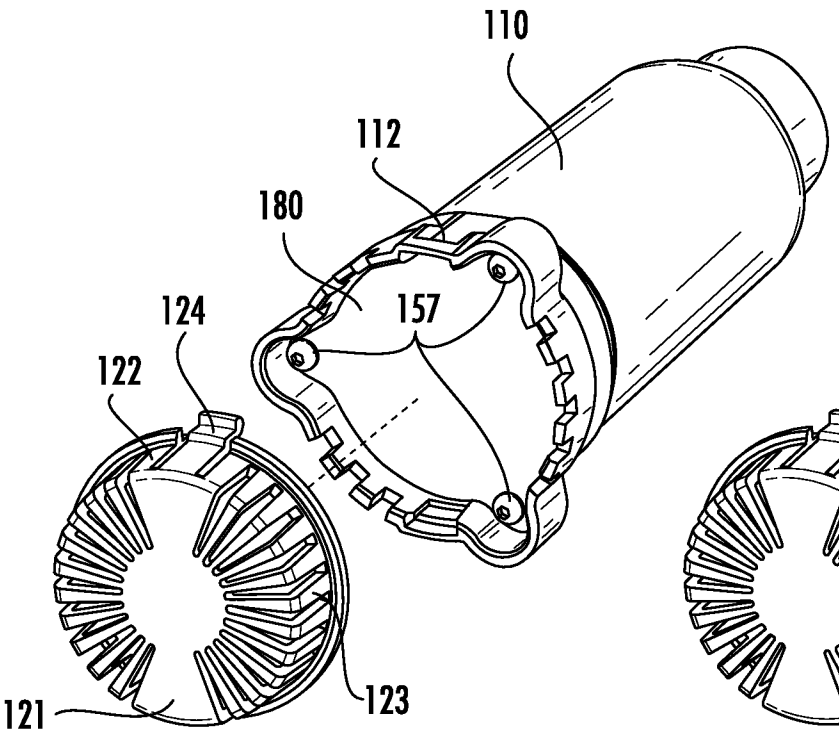
FIG. 11A is a perspective view of the pump assembly with the strainer removed.

FIGS. 11A and 11B show the configuration of strainer 120 and a portion of the cap member 150 viewed from the bottom of the pump assembly 100. Strainer 120 in the illustrated embodiment includes a round base 121 and a cylindrical sidewall 122 extending from the base 121. Openings can be formed on the base 121 and/or the sidewall 122 to introduce liquid. In an example, the openings are in the form of slots 123 extending from the sidewall 122 to the base 121. The slots 123 may be evenly distributed on the sidewall 122. The slots 123 together form the pump inlet 11. The strainer 120 may include one or more mounting features 124 designed to mate with corresponding mounting features 112 at the bottom of the pump housing 110. Referring to FIG. 1, a base 800 is provided to support the pump assembly 100. The base 800 may be attached to the strainer 120 or may replace the strainer 120.

In some examples, a filter or screen 180 is disposed between the strainer 120 and the cap member 150. The filter 180 prevents unwanted particles from entering the pump chamber 160 and causing damage to the impeller 130 and other components in the pump assembly 100. The filter 180 may be mounted to the bottom side of the cap member 150.

Figure 12:
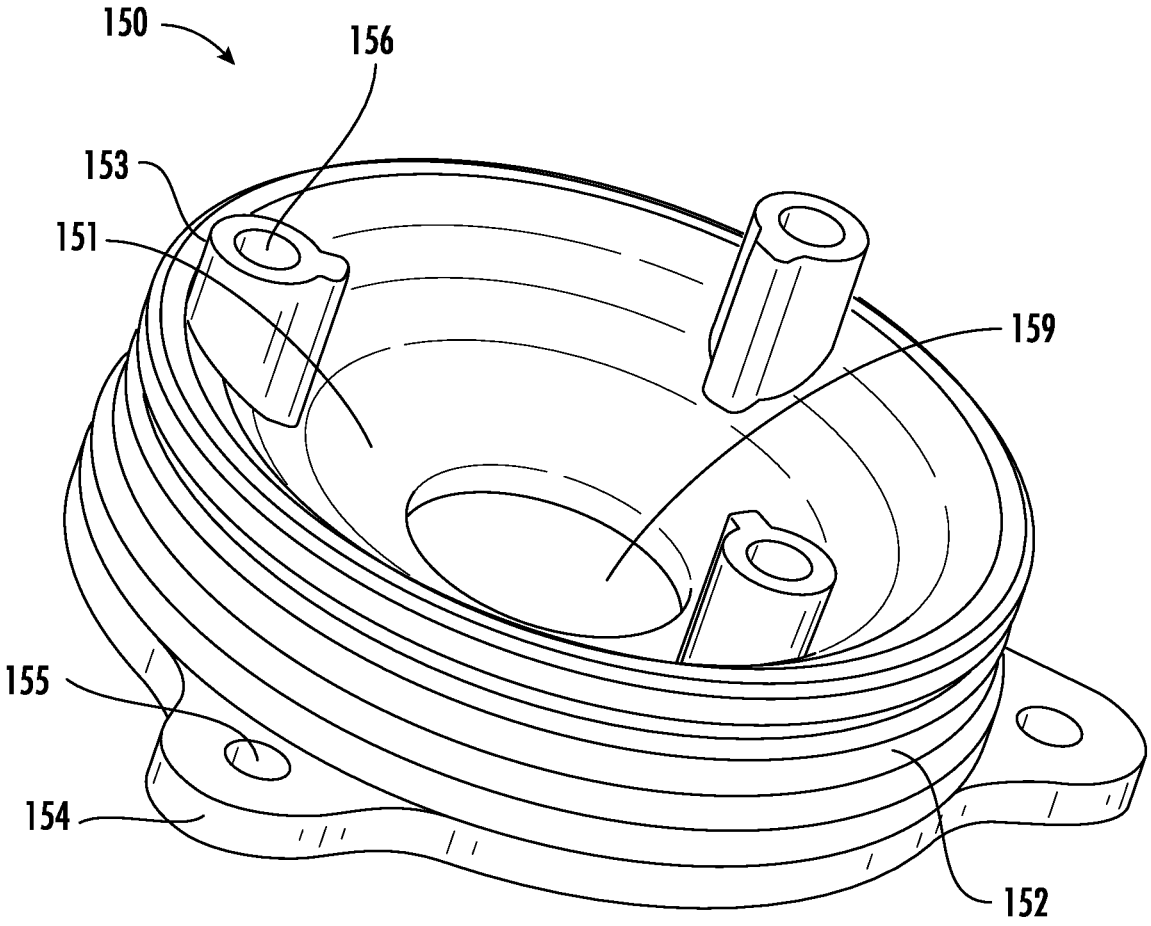
FIG. 12 is a perspective view of a cap member in the pump assembly.

FIG. 12 shows an exemplary embodiment of the cap member 150, which is mounted to the pump housing 110 as well as the motor housing 140. The cap member 150 has a bowl-shaped inner wall 151 which defines a boundary of the pump chamber 160 and a central opening 159 which forms the inlet of the pump chamber 160. An annular groove 152 may be formed on an outer wall of the cap member 150 for receiving a sealing ring 181 (shown in FIGS. 4 and 10). To allow the cap member 150 to be fixed to the pump housing 110 and the motor housing 140, two groups of fastener holes are provided. The first fastener hole 155 is formed on a lug 154 extending from the outer wall of the cap member 150. The second fastener hole 156 is formed on a post 153 extending from the inner wall 151 of the cap member 150. In the illustrated embodiment, multiple first fastener holes 155 and second fastener holes 156 are distributed circumferentially on the cap member 150.

Referring to FIGS. 11A and 11B, the first fastener hole 155 receives a first fastener 157 for mounting the cap member 150 to the pump housing 110. The second fastener hole 156 receives a second fastener 158 for mounting the cap member 150 to the motor housing 140. When the strainer 120 is removed from the pump housing 110, the first fastener 157 is accessible from the bottom side. After the first fastener 157 is removed, the filter 180 (if used) can be taken out and the second fastener 158 is exposed. In this way, the cap member 150 can be removed from the pump housing 110.

Figure 13:
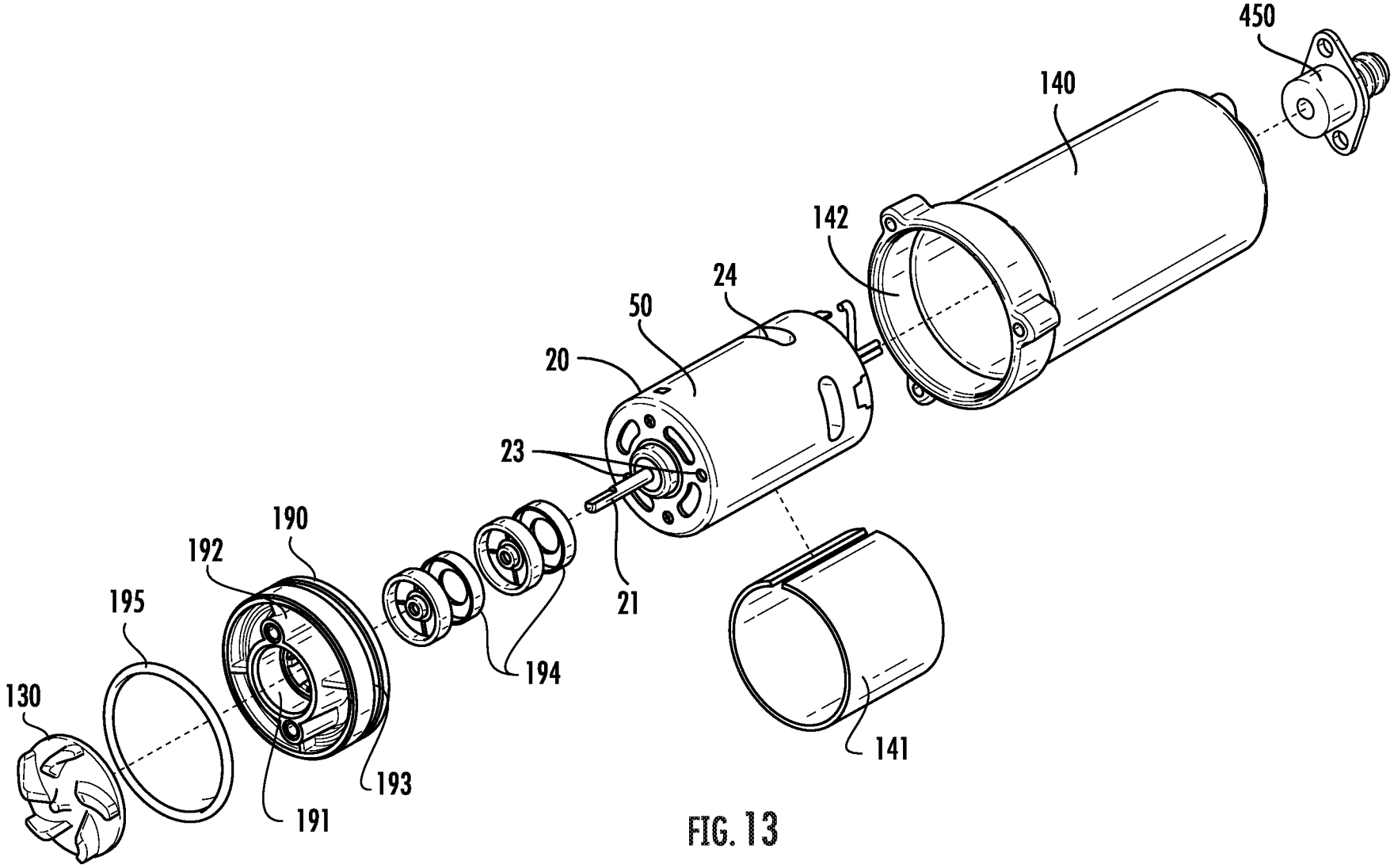
FIG. 13 is an exploded perspective view of a motor assembly in the pump assembly.

FIG. 13 depicts an exemplary embodiment of the motor assembly inside the pump housing 110. The motor assembly generally includes the motor housing 140, a motor 50 positioned in the motor housing 140 and having a motor case 20, a motor cover 190 at the lower end of the motor housing 140, and the impeller 130 drivingly coupled to an output shaft 21 of the motor 50. Electrical connector is provided at the upper end of the motor 50 for connecting the wires 420 of the cable assembly 400.

As described previously with reference to FIG. 4, the upper opening of the motor housing 140 receives the second sealing element 450. On the opposite side, the lower opening 142 of the motor housing 140 is closed and sealed by the motor cover 190. In the illustrated embodiment, the motor cover 190 includes a central opening 191 through which the output shaft 21 of the motor 50 extends. One or more fastener holes 192 are formed on the motor cover 190. The motor cover 190 may not be secured on the motor housing 140. This facilitates the replacement of components in the motor assembly.

To ensure that liquid does not enter the motor chamber, multiple sealing elements may be included in the motor assembly. For instance, an annular groove 193 is formed on an outer wall of the motor cover 190 to receive an outer seal 195. Additionally, one or more inner seals 194 are disposed in the central opening 191 of the motor cover 190 and are positioned between the motor 50 and the impeller 130.

The motor case 20 in the illustrated embodiment includes one or more fastener holes 23 formed on its bottom side. These fastener holes 23 are aligned with the fastener holes 192 on the motor cover 190. In one embodiment, a thermal conductive element 141 is disposed in the motor housing 140 and at least partially around the motor case 20. The thermal conductive element 141 may have a C-shaped cross-section. To increase the cooling ability, a fan (not shown) may be arranged in the motor case. Air openings 24 are formed on the motor case 20 and are aligned with the cooling fan in the radial direction. It is preferred that the thermal conductive element 141 does not cover the air openings 24.

Figure 14:
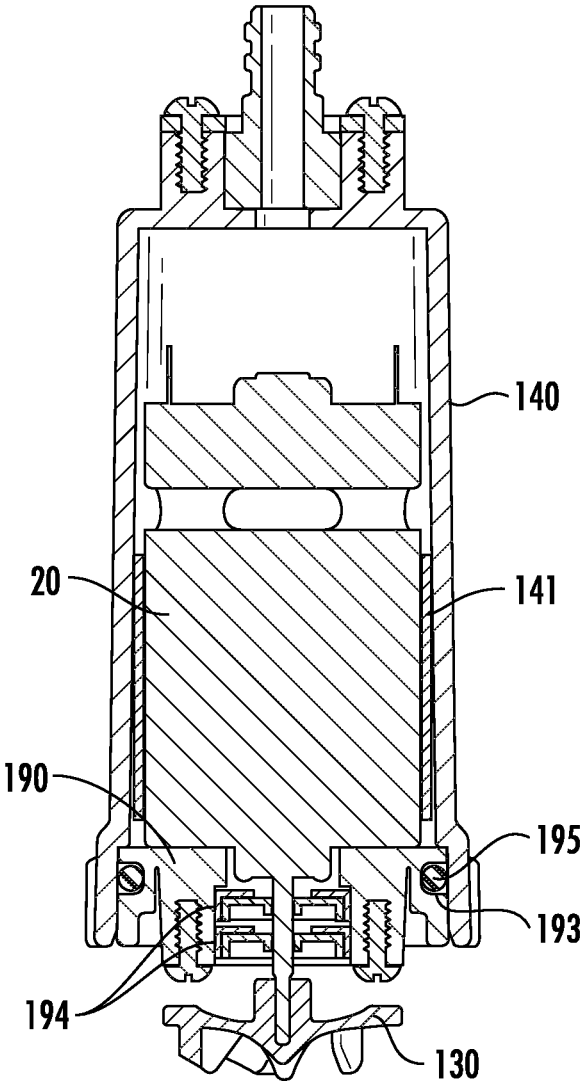
FIG. 14 is a sectional view of the motor assembly.

FIG. 14 shows the cross section of the motor assembly in FIG. 13. The thermal conductive element 141 surrounding the motor case 20 at least partially contacts the inner wall of the motor housing 140. Accordingly, heat generated by the motor can be transferred to the motor housing 140 via the thermal conductive element 141. The motor housing 140 is then cooled by the liquid flowing through the annular region 170 between the pump housing 110 and the motor housing 140.

Figure 15:
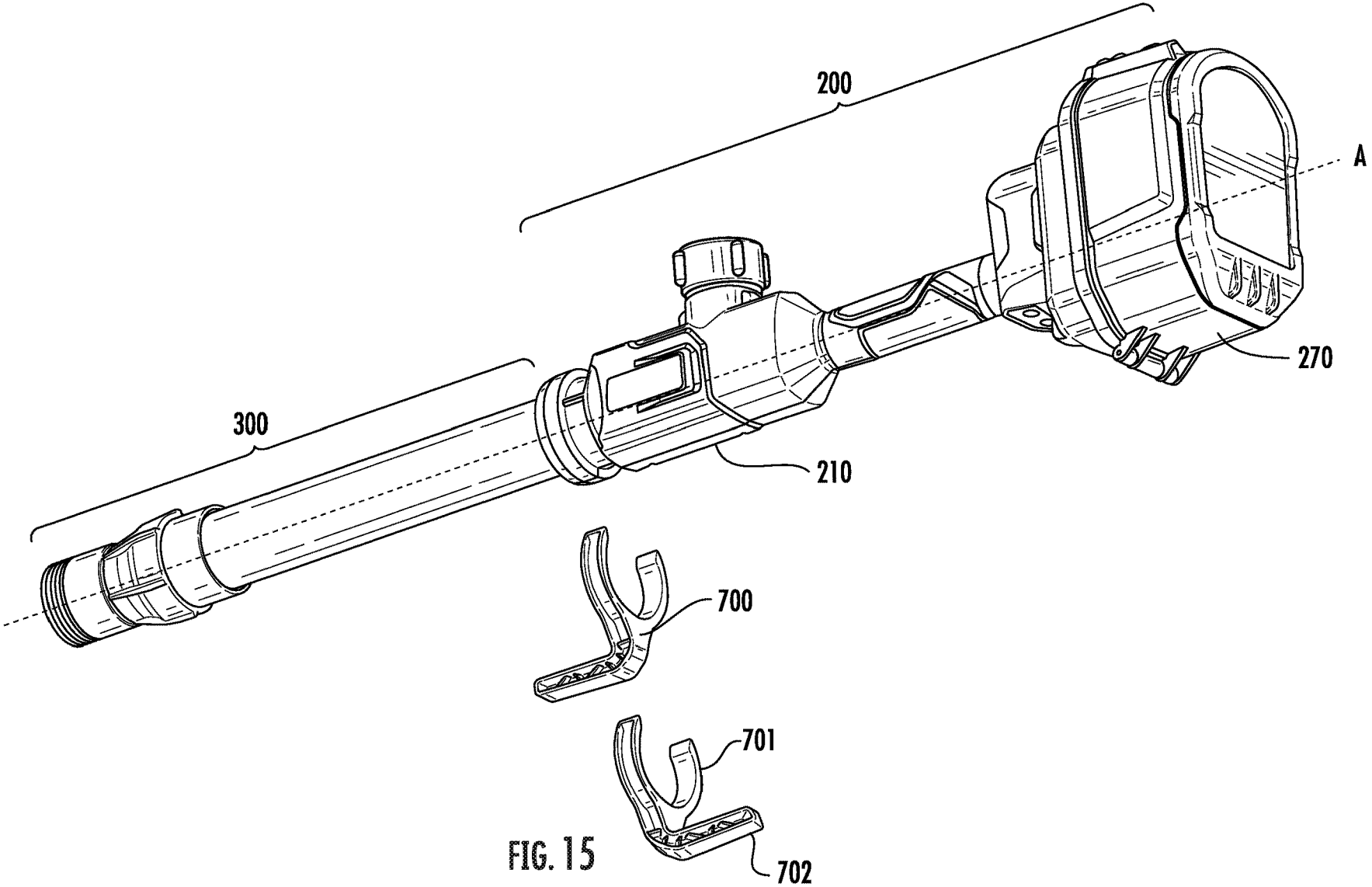
FIG. 15 is a perspective view showing the handle assembly and pole assembly.

FIG. 15 shows an embodiment of the handle assembly 200 and the pole assembly 300 in an assembled state. An accessory 700 is attachable to the pole assembly 300 or the handle assembly 200. The accessory 700 can be used as a hanger or a hook depending on its orientation with respect to the portable pump. In one embodiment, the accessory 700 has a clamp portion 701 and a hook portion 702 extending in a direction substantially perpendicular to a plane in which the clamp portion 701 lies. An annular groove may be formed on the handle housing 210 to receive the clamp portion 701. In other embodiments, the clamp portion 701 may be attached to the pole assembly 300 or the handle assembly 200 in a manner that allows rotation of the accessory 700 around the longitudinal axis A.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments described in the specification. As one of ordinary skill in the art will readily appreciate from the disclosure of the present invention, processes, machines, means, methods, or steps, presently existing or later to be developed that perform substantially the same function or achieve substantially the same result as the corresponding embodiments described herein may be utilized according to the present invention.

What is claimed is:

1. A portable pump comprising:

a pump assembly including a motor, a handle assembly including a power source mounting interface configured to attach to a power source, a pole assembly extending in a longitudinal axis, the pole assembly connecting the pump assembly and the handle assembly, and a cable assembly at least partially extending in the pole assembly, the cable assembly electrically connecting the motor to transfer power from the power source to the motor, wherein a length of the pole assembly is adjustable, and the cable assembly deforms in a direction of the longitudinal axis to adapt to an adjusted length of the pole assembly, wherein the power source mounting interface is positioned at an end of the handle assembly opposite to the pole assembly, and a control unit for controlling the motor is disposed in a position close to the power source mounting interface, wherein the control unit monitors a motor current and shuts off the motor if the motor current is below a threshold value for a predetermined period of time.

2. The portable pump according to claim 1, wherein the cable assembly has a resilient portion which is extendable or retractable in response to a change of the length of the pole assembly.

3. The portable pump according to claim 1, wherein the cable assembly includes an electrical wire and a sleeve for protecting the electrical wire, the sleeve has at least one spring-shaped section.

4. The portable pump according to claim 3, wherein the cable assembly extends into a motor housing in the pump assembly and a pipe fitting in the handle assembly, a first sealing element is provided between the pipe fitting and the cable assembly, and a second sealing element is provided between the motor housing and the cable assembly, wherein the spring-shape section is located between the first sealing element and the second sealing element.

5. The portable pump according to claim 4, wherein the first sealing element has a portion at least partially fit in an opening of the pipe fitting, the cable assembly extends through the first sealing element and is fixed to the first sealing element.

6. The portable pump according to claim 4, wherein the second sealing element has a portion at least partially fit in an upper opening of the motor housing, the cable assembly extends through the second sealing element and is fixed to the second sealing element.

7. The portable pump according to claim 1, wherein the power source mounting interface includes a hollow post extending towards a grip portion for receiving a part of the power source, and the control unit includes a circuit board that is supported on the hollow post.

8. The portable pump according to claim 1, wherein the pole assembly comprises two or more tubes of different diameters arranged in a telescopic configuration, the outermost tube having the largest diameter is connected to a pipe fitting in the handle assembly, and the innermost tube having the smallest diameter is connected to a pump housing in the pump assembly.

9. The portable pump according to claim 8, wherein the outermost tube is detachably connected to the pipe fitting by more than one connecting means, wherein the connecting means include a snap-fit connection, a threaded connection and a screw connection.

10. The portable pump according to claim 1, wherein the pole assembly comprises:

an outer tube;

an inner tube slidably disposed in the outer tube; and a locking mechanism for releasably locking the position of the inner tube relative to the outer tube.

11. The portable pump according to claim 10, wherein the pole assembly further comprises a slider including:

a coupling portion configured to be coupled to an end of the inner tube;

an enlarged portion whose outer diameter is larger than the outer diameter of the inner tube;

a mounting feature formed on the coupling portion; and a step formed between the coupling portion and the enlarged portion; wherein a mounting opening is formed near the end of the inner tube to receive the mounting feature, and a radially inward projection is formed on the outer tube, the inner tube reaches a limit position when the step abuts against the radially inward projection.

12. The portable pump according to claim 10, wherein the locking mechanism includes a locking collar secured to the outer tube, and a locking nut rotatable around the inner tube, wherein the locking collar is secured to an end of the outer tube via interference fit and a layer of adhesive is applied at an interface between the locking collar and the outer tube.

13. The portable pump according to claim 12, wherein the locking collar has a first portion secured to the outer tube and a second portion for engaging with the locking nut, an inner diameter of the second portion of the locking collar is smaller than an inner diameter of the outer tube, a first gasket is disposed between the inner tube and the first portion of the locking collar in a radially direction and between the outer tube and the second portion of the locking collar in an axial direction.

14. The portable pump according to claim 13, wherein the locking nut has a first portion for engaging with the locking collar and a second portion for locking the position of the inner tube, a compressible element is disposed between the second portion of the locking nut and the inner tube.

15. The portable pump according to claim 14, wherein the second portion of the locking nut has a tapered inner wall, and the compressible element has a tapered outer wall, when the locking nut is tightened on the locking collar, the tapered inner wall of the locking nut pushes the tapered outer wall of the compressible element to lock the position of the inner tube relative to the outer tube.

16. The portable pump according to claim 15, wherein a second gasket is positioned between the compressible element and the second portion of the locking collar in the axial direction, and an O-shaped ring is further positioned between the second gasket and the second portion of the locking collar in the axial direction.

17. The portable pump according to claim 1, wherein the pump assembly comprises:

a pump housing;

a strainer mounted to a bottom end of the pump housing and defining a pump inlet;

an impeller positioned in the pump housing;

a motor housing positioned in the pump housing;

a cap member positioned between the strainer and the motor housing and defining at least a part of a pump chamber in which the impeller is disposed, wherein liquid drawn from the pump inlet is moved by the impeller to flow radially outward through the pump chamber, upward through an annular region between the pump housing and the motor housing, and to the pole assembly.

18. A portable pump comprising:

a pump assembly including a motor, a handle assembly including a power source mounting interface configured to receive a power source, a pole assembly extending along a longitudinal axis, the pole assembly connecting the pump assembly and the handle assembly, a cable assembly at least partially extending in the pole assembly, the cable assembly electrically connecting the motor to the power source, wherein the cable assembly comprises an electrical wire and a waterproof sleeve protecting the electrical wire to prevent a liquid driven by the motor through the pole assembly from contacting the electrical wire, wherein the driven liquid contacts the waterproof sleeve, wherein a length of the pole assembly is adjustable, and wherein the cable assembly deforms in a direction of the longitudinal axis to adapt to the adjusted length of the pole assembly, and a pipe fitting at least partially disposed in the handle assembly, wherein the pipe fitting has an inlet portion connected to the pole assembly, an outlet portion forming an pump outlet, and a sealed portion through which the cable assembly passes to the handle assembly.

19. The portable pump of claim 18, wherein the power source mounting interface is positioned at an end of the handle assembly opposite to the pole assembly, and a control unit for controlling the motor is disposed in a position close to the power source mounting interface, wherein the control unit monitors a motor current and shuts off the motor if the motor current is below a threshold value for a predetermined period of time.

20. The portable pump of claim 18, wherein the cable assembly has a resilient portion which is extendable or retractable in response to a change of the length of the pole assembly.

* * * * *